US011784017B2

(12) United States Patent
Kawaguchi et al.

(10) Patent No.: US 11,784,017 B2
(45) Date of Patent: Oct. 10, 2023

(54) ELECTROMAGNETIC RELAY

(71) Applicant: OMRON Corporation, Kyoto (JP)

(72) Inventors: Naoki Kawaguchi, Yame (JP); Ryota Minowa, Yamaga (JP); Yasuo Hayashida, Kumamoto (JP); Shingo Mori, Yamaga (JP); Kohei Otsuka, Omuta (JP); Hiroyuki Iwasaka, Kumamoto (JP)

(73) Assignee: OMRON CORPORATION, Kyoto (JP)

( * ) Notice: Subject to any disclaimer, the term of this patent is extended or adjusted under 35 U.S.C. 154(b) by 218 days.

(21) Appl. No.: 17/297,461

(22) PCT Filed: Oct. 16, 2019

(86) PCT No.: PCT/JP2019/040550
§ 371 (c)(1),
(2) Date: May 27, 2021

(87) PCT Pub. No.: WO2020/137095
PCT Pub. Date: Jul. 2, 2020

(65) Prior Publication Data

US 2021/0398763 A1 Dec. 23, 2021

(30) Foreign Application Priority Data

Dec. 28, 2018 (JP) ..... 2018-246969

(51) Int. Cl.
*H01H 50/38* (2006.01)
*H01H 50/02* (2006.01)

(52) U.S. Cl.
CPC ..... *H01H 50/38* (2013.01); *H01H 50/02* (2013.01)

(58) Field of Classification Search
CPC ..... H01H 50/38; H01H 50/02; H01H 50/42; H01H 50/54
See application file for complete search history.

(56) References Cited

U.S. PATENT DOCUMENTS 8,461,950 B2 * 6/2013 Lim ..... H01H 33/64 335/131
8,514,037 B2 * 8/2013 Hsu ..... H01H 50/643 335/133

(Continued)

FOREIGN PATENT DOCUMENTS

JP 2011-204473 A 10/2011
JP 2014-110094 A 6/2014

(Continued)

OTHER PUBLICATIONS

Machine translation of NGK, WO 2012060090A (2012) (Year: 2012).*

(Continued)

*Primary Examiner* — Bernard Rojas
(74) *Attorney, Agent, or Firm* — SHINJYU GLOBAL IP

(57) ABSTRACT

An electromagnetic relay includes a pair of fixed terminals including a fixed contact, a movable contact piece, a housing portion, and a magnet portion. The movable contact piece includes a movable contact disposed facing the fixed contact. The movable contact piece is movable in a first direction in which the movable contact contacts the fixed contact and a second direction in which the movable contact separates from the fixed contact. The housing portion includes a housing space housing the fixed contact and movable contact piece. The magnet portion includes a pair of magnets disposed around the housing portion so as to face each other in a longitudinal direction of the movable contact piece and extending in the second direction beyond the housing space. The magnet portion generates a magnetic flux flowing in a (Continued)

direction parallel to the longitudinal direction between the fixed contact and the movable contact.

9 Claims, 7 Drawing Sheets

(56) References Cited

U.S. PATENT DOCUMENTS

| | | | | |
|---|---|---|---|---|
| 8,937,518 | B2 * | 1/2015 | Suzuki | H01H 9/443 335/131 |
| 11,348,750 | B2 * | 5/2022 | Kawaguchi | H01H 9/443 |
| 2012/0175345 | A1 * | 7/2012 | Tachikawa | H01H 9/443 218/26 |
| 2013/0214881 | A1 | 8/2013 | Ito et al. | |
| 2013/0214882 | A1 | 8/2013 | Ito et al. | |
| 2013/0214884 | A1 | 8/2013 | Ito et al. | |
| 2014/0176268 | A1 | 6/2014 | Suzuki et al. | |

FOREIGN PATENT DOCUMENTS

| | | | |
|---|---|---|---|
| WO | 2012/029218 | A1 | 3/2012 |
| WO | 2012/060090 | A1 | 5/2012 |

OTHER PUBLICATIONS

International Search Report of International Application No. PCT/JP2019/040550 dated Jan. 7, 2020.
Written Opinion of the International Searching Authority of International Application No. PCT/JP2019/040550 dated Jan. 7, 2020.

* cited by examiner

ELECTROMAGNETIC RELAY

CROSS-REFERENCE TO RELATED APPLICATION

This application is the U.S. National Phase of International Application No. PCT/JP2019/040550, filed on Oct. 16, 2019. This application claims priority to Japanese Patent Application No. 2018-246969, filed Dec. 28, 2018. The contents of those applications are incorporated by reference herein in their entireties.

FIELD

The present invention relates to an electromagnetic relay.

BACKGROUND

Conventionally, in electromagnetic relays, electromagnetic relays that use a magnetic force of a magnet to extend and extinguish an arc generated at a contact are known. For example, in Japanese Laid-Open Patent Application No. 2014-110094, a pair of magnets are arranged so that different poles face each other in a longitudinal direction of a movable contact piece, and magnetic flux flows in the longitudinal direction of the movable contact piece with respect to the contact. Lorentz force due to the magnetic force of the pair of magnets act on the arc generated at the contact, and the arc is extended toward an arc extinguishing space.

SUMMARY

FIG. 11 is a view schematically showing a magnetic flux flowing between the pair of magnets. Specifically, the figure schematically shows the magnetic flux flowing between the pair of magnets 101, 102 when the pair of magnets 101, 102 are arranged so that different poles face each other in the longitudinal direction (left-right direction in FIG. 11) of the movable contact piece 103. A lateral direction of the movable contact piece 103 in FIG. 11 is a direction orthogonal to a paper surface of FIG. 11. As illustrated in FIG. 11, the magnetic flux flowing between the pair of magnets 101 and 102 flows in a direction parallel to the longitudinal direction of the movable contact piece 103 near the center of the magnets 101 and 102, that is, near contacts 104 and 105. On the other hand, at a position separated from the contacts 104 and 105 in an up-down direction (up-down direction in FIG. 11), the magnetic flux between the pair of magnets 101 and 102 is curved so as to spread in the up-down direction. Therefore, when the arc is extended in the up-down direction, the direction of the Lorentz force acting on the arc changes. Therefore, it is difficult to control an extension direction of the arc in the intended direction at a position separated from the contacts 104 and 105 in the up-down direction.

Further, since the magnetic field is strong and the direction of the magnetic flux changes near the end of the magnet, it is difficult to control the extension direction of the arc in the intended direction even when the space for extending the arc is close to the end of the magnet.

An object of the present invention is to make it easy to control the extension direction of the arc in the electromagnetic relay.

An electromagnetic relay according to one aspect of the present invention includes a pair of fixed terminals, a movable contact piece, a housing portion, and a magnet portion. The pair of fixed terminals includes a fixed contact.

The movable contact piece includes a movable contact disposed facing the fixed contact, and is movable in a first direction in which the movable contact contacts the fixed contact and a second direction in which the movable contact separates from the fixed contact. The housing portion includes a housing space housing the fixed contact and movable contact piece. The magnet portion includes a pair of magnets disposed around the housing portion so as to face each other in a longitudinal direction of the movable contact piece and extending in the second direction beyond the housing space. The magnet portion generates a magnetic flux flowing in a direction parallel to the longitudinal direction between the fixed contact and the movable contact.

In this electromagnetic relay, since the pair of magnets extends in the second direction beyond the housing space, the range of the magnetic flux flowing in the housing space in the direction parallel to the longitudinal direction of the movable contact piece becomes wider in the second direction. Thereby, for example, it is possible to suppress a large change in the direction of the Lorentz force acting on the arc even at a position separated from the fixed contact and the movable contact in the second direction. Therefore, for example, when the arc extends in the second direction, the direction of the Lorentz force acting on the arc does not change significantly, so that the extension direction of the arc can be easily controlled. Further, since the end portion of the magnet can be disposed at a position separated from the housing space in the second direction, it is possible to prevent the direction of the Lorentz force acting on the arc from changing due to change in the direction of the magnetic flux.

Preferably, the housing space includes an arc extension space for extending an arc generated between the fixed contact and the movable contact that is disposed at least partially on the second direction side with respect to the movable contact piece. In the arc extension space, an angle formed by the magnetic flux line of a magnetic field at a position farthest from the movable contact piece in the second direction and a straight line parallel to the longitudinal direction is within 45°. In this case, it is possible to effectively suppress a large change in the direction of the Lorentz force acting on the arc even at a position separated from the fixed contact and the movable contact in the second direction.

Preferably, a dimension of the pair of magnets in a lateral direction of the movable contact piece is larger than a dimension of the housing space in the lateral direction. In this case, since the range of the magnetic flux flowing in the direction parallel to the longitudinal direction in the housing space becomes wider in the lateral direction, it is possible to suppress a large change in the direction of the Lorentz force acting on the arc even at a position separated from the fixed contact and the movable contact to the outside in the lateral direction.

Preferably, the magnet portion further includes a pair of second magnets that are disposed around the housing portion so as to face each other in the lateral direction of the movable contact piece and extend in a second direction beyond the housing space. In this case, when a pair of second magnets are disposed, the range of the magnetic flux flowing in the direction parallel to the longitudinal direction of the movable contact piece in the housing space can be widened in the second direction.

Preferably, the pair of magnets and the pair of second magnets extend in the first direction beyond the housing space. In this case, since the range of the magnetic flux flowing in the direction parallel to the longitudinal direction of the movable contact piece in the housing space becomes wider in the first direction, it is possible to suppress a large change in direction of the Lorentz force acting on the arc when the arc extends in the first direction. Further, since the end portion of the magnet can be disposed at a position separated from the housing space in the first direction, it is possible to prevent the direction of the Lorentz force acting on the arc from changing due to change in the direction of the magnetic flux.

An electromagnetic relay according to another aspect of the present invention includes a pair of fixed terminals, a movable contact piece, a housing portion, and a magnet portion. The pair of fixed terminals includes a fixed contact. The movable contact piece includes a movable contact disposed facing the fixed contact, and is movable in a first direction in which the movable contact contacts the fixed contact and a second direction in which the movable contact separates from the fixed contact. The housing portion includes a housing space housing the fixed contact and movable contact piece. The magnet portion includes a pair of magnets disposed around the housing portion so as to face each other in a lateral direction of the movable contact pieces and extending in the second direction beyond the housing space. The magnet portion generates a magnetic flux flowing in a direction parallel to the lateral direction between the fixed contact and the movable contact.

In this electromagnetic relay, since the pair of magnets extends in the second direction beyond the housing space, the range of the magnetic flux flowing in the housing space in the direction parallel to the lateral direction of the movable contact piece becomes wider in the second direction. Thereby, for example, it is possible to suppress a large change in the direction of the Lorentz force acting on the arc even at a position separated from the fixed contact and the movable contact in the second direction. Therefore, for example, when the arc extends in the second direction, the direction of the Lorentz force acting on the arc does not change significantly, so that the extension direction of the arc can be easily controlled. Further, since the end portion of the magnet can be disposed at a position separated from the housing space in the second direction, it is possible to prevent the direction of the Lorentz force acting on the arc from changing due to change in the direction of the magnetic flux.

Preferably, the housing space includes an arc extension space for extending an arc generated between the fixed contact and the movable contact that is disposed at least partially on the second direction side with respect to the movable contact piece. In the arc extension space, an angle formed by a magnetic flux line of the magnetic field at a position farthest from the movable contact piece in the second direction and a straight line parallel to the lateral direction is within 45°. In this case, it is possible to effectively suppress a large change in the direction of the Lorentz force acting on the arc even at a position separated from the fixed contact and the movable contact in the second direction.

Preferably, a dimension of the pair of magnets in a longitudinal direction of the movable contact piece is larger than a dimension of the housing space in the longitudinal direction. In this case, since the range of the magnetic flux flowing in the direction parallel to the lateral direction in the housing space becomes wider in the lateral direction, it is possible to suppress a large change in the direction of the acting Lorentz force acting on the arc even at a position separated from the fixed contact and the movable contact to the outside in the lateral direction.

Preferably, the pair of magnets extends in a first direction beyond the housing space. In this case, when the arc extends in the first direction, the direction of the Lorentz force acting on the arc does not change significantly, so that the extension direction of the arc can be easily controlled. Further, since the end portion of the magnet can be disposed at a position separated from the housing space in the first direction, it is possible to prevent the direction of the Lorentz force acting on the arc from changing due to change in the direction of the magnetic flux.

Preferably, the pair of fixed terminals is plate-shaped terminals extending in a longitudinal direction of the movable contact piece. In this case, in an electromagnetic relay using a plate-shaped fixed terminal, it becomes possible to easily control the extension direction of the arc.

DETAILED DESCRIPTION

Figure 1:
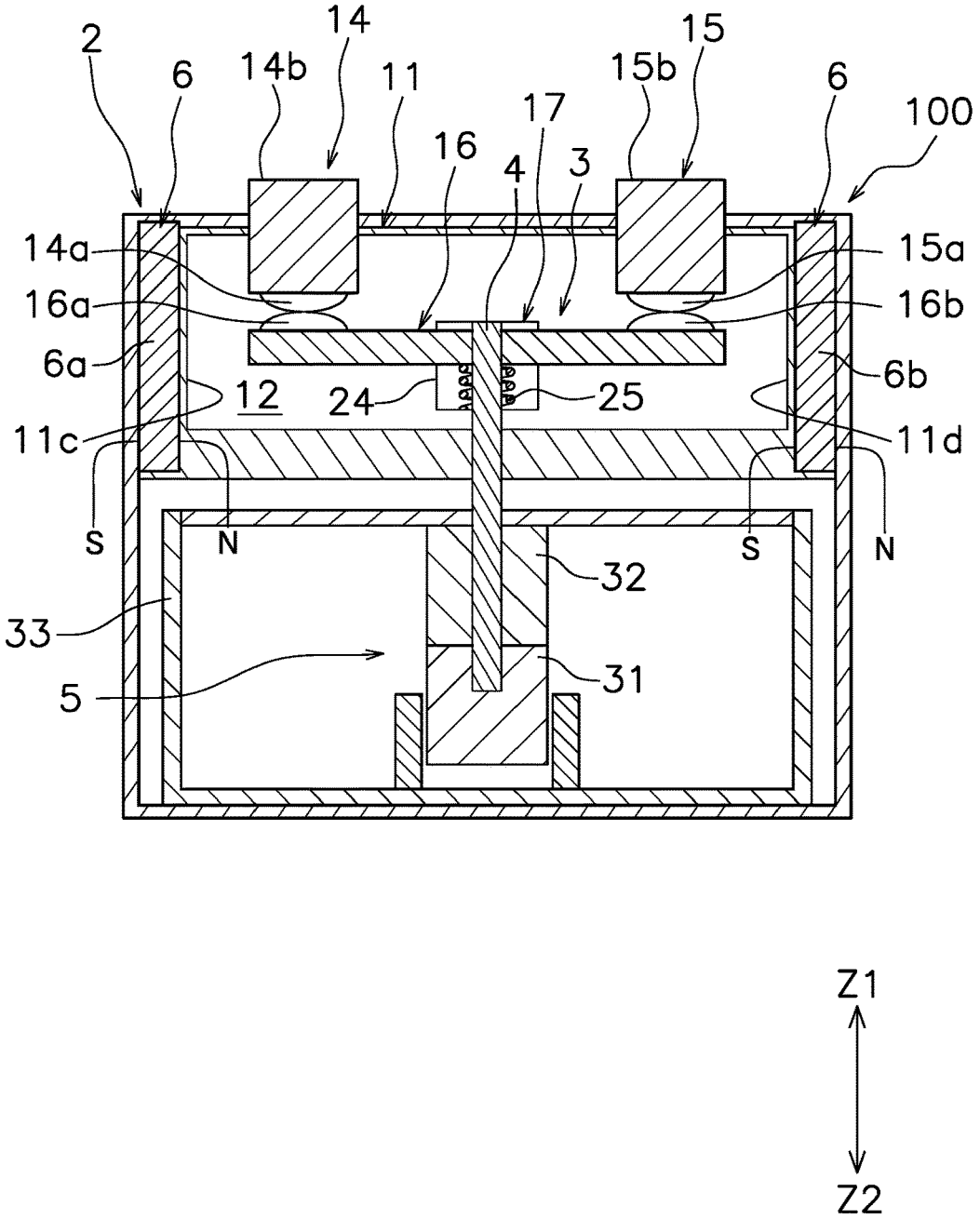
FIG. 1 is a schematic cross-sectional view of an electromagnetic relay.

Hereinafter, embodiments of an electromagnetic relay according to one aspect of the present invention will be described with reference to the drawings. FIG. 1 is a schematic cross-sectional view of an electromagnetic relay 100. As illustrated in FIG. 1, the electromagnetic relay 100 includes a housing 2, a contact device 3, a drive shaft 4, an electromagnetic drive device 5, and a magnet portion 6.

When referring to the drawings, an upper side in FIG. 1 is referred to as "up", a lower side is referred to as "down", the left side referred to as "left", and the right side referred to as "right" in order to facilitate understanding of the description. In addition, a direction orthogonal to the paper surface of FIG. 1 will be described as a front-back direction. In this embodiment, a contact direction Z1 is downward in FIG. 1. Further, a separation direction Z2 is upward in FIG. 1. The details of the contact direction Z1 and the separation direction Z2 will be described later.

The housing 2 has a substantially quadrangular box shape and is made of an insulating material. A contact device 3, a drive shaft 4, an electromagnetic drive device 5, and a magnet portion 6 are housed inside the housing 2.

The housing 2 includes a housing portion 11. The housing portion 11 is composed of, for example, a substantially rectangular parallelepiped case member disposed in the housing 2. The housing portion 11 is made of an insulating material.

Figure 2:
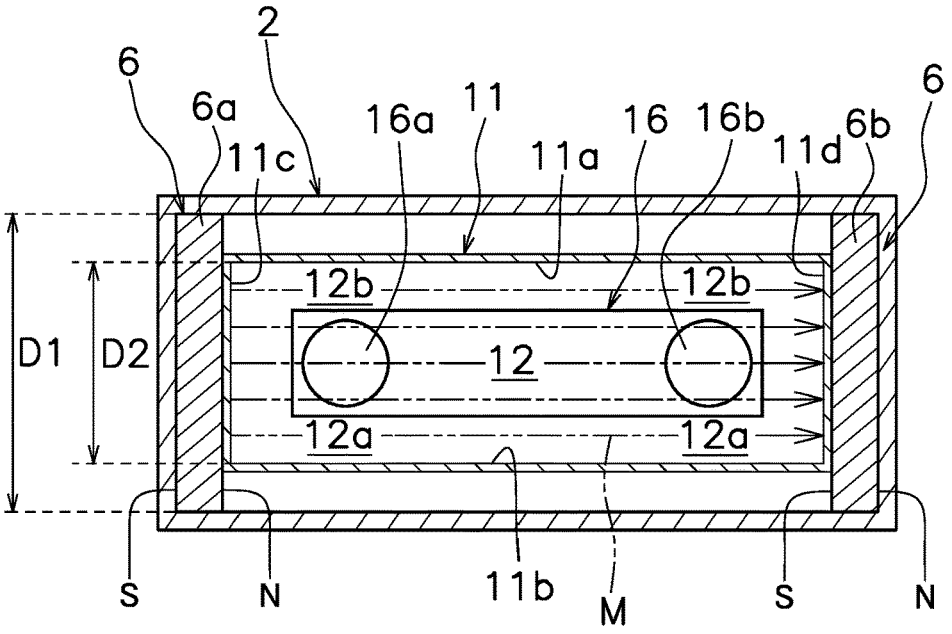
FIG. 2 is a schematic view showing the configurations of a magnet portion and a housing portion.

FIG. 2 is a schematic view showing the configurations of the magnet portion 6 and the housing portion 11, and is a schematic view of the cross section around the housing portion 11 as viewed from above. The housing portion 11 includes a first inner wall surface 11*a*, a second inner wall surface 11*b*, a third inner wall surface 11*c*, and a fourth inner wall surface 11*d*. Each of the first to fourth inner wall surfaces 11*a* to 11*d* is the front, back, left, and right inner surfaces of the housing portion 11. The first inner wall surface 11*a* and the second inner wall surface 11*b* extend in the up-down direction and the left-right direction. The first inner wall surface 11*a* and the second inner wall surface 11*b* are disposed to face each other in the front-back direction. The third inner wall surface 11*c* and the fourth inner wall surface 11*d* extend in the up-down direction and the front-back direction. The third inner wall surface 11*c* and the fourth inner wall surface 11*d* are disposed to face each other in the left-right direction. The dimensions of the first inner wall surface 11*a* and the second inner wall surface 11*b* in the left-right direction are longer than the dimensions of the third inner wall surface 11*c* and the fourth inner wall surface 11*d* in the up-down direction.

The housing portion 11 includes a housing space 12 for housing the contact device 3. In the present embodiment, the housing space 12 is composed of a substantially rectangular parallelepiped space that is shielded from the outside. The sides of the housing space 12 are surrounded by the first to fourth inner wall surfaces 11*a* to 11*d*.

As illustrated in FIG. 1, the contact device 3 includes a first fixed terminal 14, a second fixed terminal 15, a movable contact piece 16, and a contact piece holding portion 17. The first fixed terminal 14, the second fixed terminal 15, and the movable contact piece 16 are made of a conductive material.

The first fixed terminal 14 and the second fixed terminal 15 are columnar terminals and extend in the up-down direction. The first fixed terminal 14 and the second fixed terminal 15 are fixed to an upper portion of the housing 2 at intervals each other in the left-right direction. The first fixed terminal 14 and the second fixed terminal 15 are examples of a pair of fixed terminals.

The first fixed terminal 14 includes a first fixed contact 14*a* and a first external connection portion 14*b*. The first fixed contact 14*a* is disposed in the housing space 12. The first external connection portion 14*b* protrudes upward from the housing 2 and is exposed to the outside. The second fixed terminal 15 includes a second fixed contact 15*a* and a second external connection portion 15*b*. The second fixed contact 15*a* is disposed in the housing space 12. The second external connection portion 15*b* protrudes upward from the housing 2 and is exposed to the outside.

As illustrated in FIGS. 1 and 2, the movable contact piece 16 is a plate-shaped member that is long in one direction and extends in the left-right direction in the housing space 12. The movable contact piece 16 is disposed in the housing space 12 at intervals in the front-back direction from the first inner wall surface 11*a* and the second inner wall surface 11*b*. An arc extension space 12*a*, 12*b* for extending an arc is provided between the movable contact piece 16 and the first inner wall surface 11*a*, and between the movable contact piece 16 and the second inner wall surface 11*b*. The arc extension spaces 12*a* and 12*b* are disposed at positions close to the first fixed contact 14*a* and the first movable contact 16*a* described later, or the second fixed contact 15*a* and the second movable contact 16*b* described later. At least a portion of the arc extension spaces 12*a* and 12*b* is disposed on the separation direction Z2 side with respect to the movable contact piece 16.

The movable contact piece 16 is disposed in the housing space 12 at a distance in the left-right direction from the third inner wall surface 11*c* and the fourth inner wall surface 11*d*. The movable contact piece 16 is disposed below the first fixed terminal 14 and the second fixed terminal 15. In the present embodiment, a longitudinal direction of the movable contact piece 16 coincides with the left-right direction. Further, a lateral direction of the movable contact piece 16 coincides with the front-back direction.

The movable contact piece 16 includes a first movable contact 16*a* and a second movable contact 16*b*. The first movable contact 16*a* is disposed to face the first fixed contact 14*a* and can contact the first fixed contact 14*a*. The second movable contact 16*b* is disposed at a distance from the first movable contact 16*a* in the left-right direction. The second movable contact 16*b* is disposed to face the second fixed contact 15*a* and can contact the second fixed contact 15*a*.

The movable contact piece 16 can move in the contact direction Z1 that contacts the first fixed contact 14*a* and the second fixed contact 15*a* and the separation direction Z2 that separates from the first fixed contact 14*a* and the second fixed contact 15*a*. The contact direction Z1 is an example of the first direction, and the separation direction Z2 is an example of the second direction.

The contact direction Z1 is the direction in which the first movable contact 16*a* and the second movable contact 16*b* contact the first fixed contact 14*a* and the second fixed contact 15*a* (upper in FIG. 1). The separation direction Z2 is the direction in which the first movable contact 16*a* and the second movable contact 16*b* separate from the first fixed contact 14*a* and the second fixed contact 15*a* (lower in FIG. 1).

As illustrated in FIG. 1, the contact piece holding portion 17 holds the movable contact piece 16 via the drive shaft 4. The contact piece holding portion 17 connects the movable contact piece 16 and the drive shaft 4. The contact piece holding portion 17 includes a holder 24 and a contact spring 25. The contact spring 25 urges the drive shaft 4 and the movable contact piece 16 toward the contact direction Z1.

The drive shaft 4 extends along the contact direction Z1 and the separation direction Z2. The drive shaft 4 can move together with the movable contact piece 16 in the contact direction Z1 and the separation direction Z2.

The electromagnetic drive device 5 drives the contact device 3. The electromagnetic drive device 5 moves the movable contact piece 16 together with the drive shaft 4 in the contact direction Z1 and the separation direction Z2 by an electromagnetic force. The electromagnetic drive device 5 is disposed below the housing portion 11 in the housing 2.

The electromagnetic drive device 5 includes a movable iron core 31, a fixed iron core 32, and a yoke 33. Further, the electromagnetic drive device 5 includes a coil, a spool, and a coil spring (not illustrated). The electromagnetic drive device 5 has the same configuration as the conventional one, detailed description thereof will be omitted.

Next, the operation of the electromagnetic relay 100 will be described. The operation of the electromagnetic relay 100 is the same as that of the conventional one, it will be briefly described.

FIG. 1 shows a state in which a voltage is applied to the coil. When the voltage is applied to the coil, the movable iron core 31 moves in the contact direction Z1 against an elastic force of the coil spring. With the movement of the contact direction Z1 of the movable iron core 31, the drive shaft 4 and the movable contact piece 16 move in the contact direction Z1, and the first movable contact 16*a* and the second movable contact 16*b* contact the first fixed contact 14*a* and the second fixed contact 15*a*. When the application of the voltage to the coil is stopped, the movable iron core 31 moves in the separation direction Z2 together with the movable contact piece 16 by the elastic force of the coil spring. As a result, the first movable contact 16*a* and the second movable contact 16*b* are in a state of being separated from the first fixed contact 14*a* and the second fixed contact 15*a*. When the first movable contact 16*a* and the second movable contact 16*b* separate from the first fixed contact 14*a* and the second fixed contact 15*a*, an arc is generated between the first movable contact 16*a* and the first fixed contact 14*a*, and between the second movable contact 16*b* and the second fixed contact 15*a*.

Figure 3:
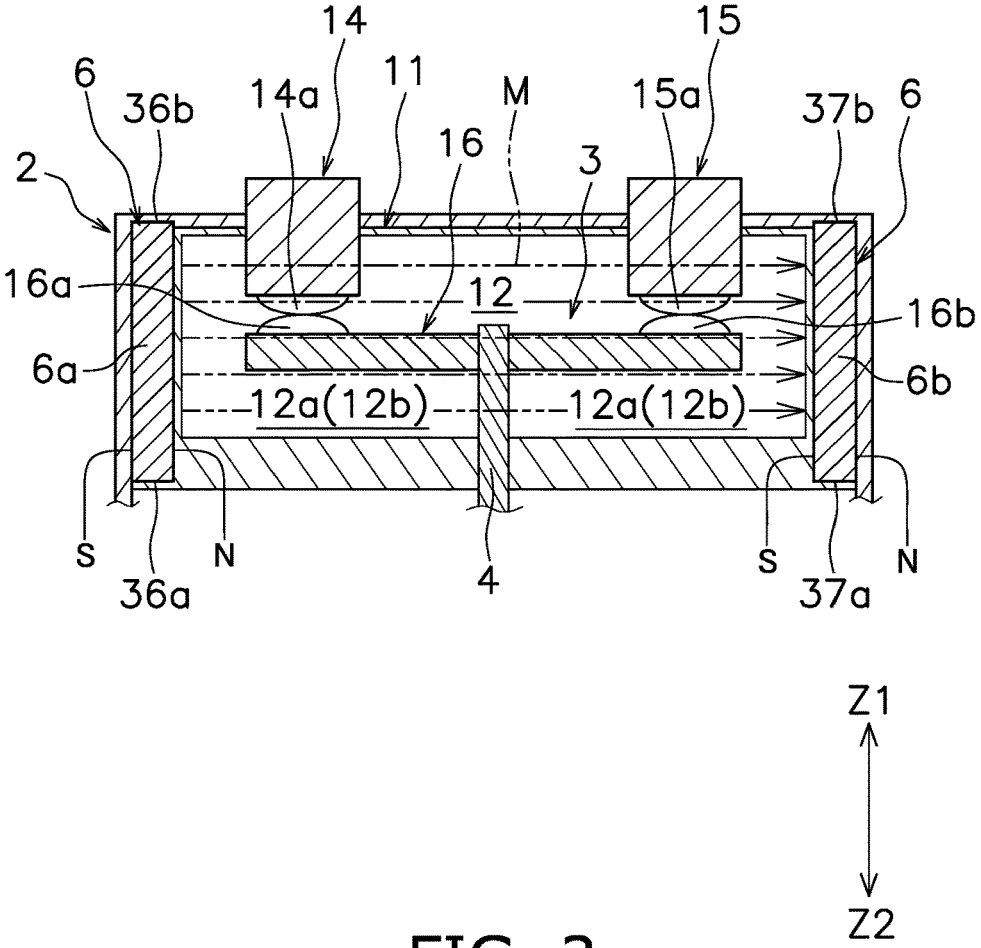
FIG. 3 is a schematic view of a cross section around a housing portion as viewed from the back.

FIG. 3 is a schematic view of a cross section around the housing portion 11 as viewed from the back. FIG. 3 schematically shows a flow of a magnetic flux M in the housing space 12. In FIG. 3, the configuration of the contact piece holding portion 17 is omitted.

The magnet portion 6 generates a magnetic field in the housing space 12. Specifically, the magnet portion 6 generates the magnetic flux flowing in a direction parallel to the longitudinal direction of the movable contact piece 16 between the first fixed contact 14*a* and the first movable contact 16*a*, and between the second fixed contact 15*a* and the second movable contact 16*b*.

The magnet portion 6 includes a first magnet 6*a* and a second magnet 6*b*. The first magnet 6*a* and the second magnet 6*b* are examples of a pair of magnets. The first magnet 6*a* and the second magnet 6*b* are permanent magnets. The first magnet 6*a* and the second magnet 6*b* extend in the front-back direction and the up-down direction. The first magnet 6*a* and the second magnet 6*b* are disposed around the housing portion 11 so as to face each other in the longitudinal direction of the movable contact piece 16. The first magnet 6*a* and the second magnet 6*b* are disposed so that different poles face each other. Specifically, the first magnet 6*a* is disposed on the left side of the housing portion 11, and the N pole is disposed facing the housing portion 11. The second magnet 6*b* is disposed on the right side of the housing portion 11, and the S pole is disposed facing the housing portion 11. The first magnet 6*a* and the second magnet 6*b* are fixed to an outer periphery of the housing portion 11 in the present embodiment.

The first magnet 6*a* and the second magnet 6*b* extend in the separation direction Z2 beyond the housing space 12. Specifically, as illustrated in FIG. 3, an end portion 36*a* of the first magnet 6*a* on the separation direction Z2 side and an end portion 37*a* of the second magnet 6*b* on the separation direction Z2 side are located on the separation direction Z2 side with respect to the housing space 12. As a result, the range of the magnetic flux flowing in the housing space 12 in the direction parallel to the longitudinal direction of the movable contact piece 16 becomes wider in the separation direction Z2.

Specifically, as illustrated in FIG. 3, the magnetic flux M flowing from the first magnet 6*a* toward the second magnet 6*b* flows in a direction parallel to the longitudinal direction of the movable contact piece even at a position in the housing space 12 separated from the movable contact piece 16 in the separation direction Z2. Therefore, when the arc extends in the separation direction Z2, the direction of the Lorentz force acting on the arc does not change significantly, so that the extension direction of the arc can be easily controlled. Further, since the end portion 36*a* of the first magnet 6*a* and the end portion 37*a* of the second magnet 6*b* can be disposed at positions separated from the housing space 12 in the separation direction Z2, when the arc is extended in the separation direction Z2, it is possible to prevent the direction of the Lorentz force acting on the arc from changing due to the change in the direction of the magnetic flux.

In the present embodiment, the first magnet 6*a* and the second magnet 6*b* extend in the contact direction Z1 beyond the housing space 12. Specifically, an end portion 36*b* on the contact direction Z1 side of the first magnet 6*a* and an end portion 37*b* on the contact direction Z1 side of the second magnet 6*b* are located on the contact direction Z1 side with respect to the housing space 12. Therefore, the range of the magnetic flux flowing in the direction parallel to the longitudinal direction of the movable contact piece 16 in the housing space 12 is widened in the contact direction Z1 as well. Therefore, even when the arc extends in the contact direction Z1, the same effect as described above can be obtained.

Further, as illustrated in FIG. 2, the dimensions D1 of the first magnet 6*a* and the second magnet 6*b* in the lateral direction of the movable contact piece 16 are preferably larger than the dimension D2 of the housing space 12 in the lateral direction of the movable contact piece 16. Specifically, both ends of the first magnet 6*a* in the lateral direction of the movable contact piece 16 extend outward beyond the housing space 12 in the lateral direction of the movable contact piece 16. In the present embodiment, both ends of the first magnet 6*a* in the lateral direction of the movable contact piece 16 extend outward beyond the housing portion 11 in the lateral direction of the movable contact piece 16. Similarly, both ends of the second magnet 6*b* in the lateral direction of the movable contact piece 16 extend outward beyond the housing space 12 in the lateral direction of the movable contact piece 16. In the present embodiment, both ends of the second magnet 6*b* in the lateral direction of the movable contact piece 16 extend outward beyond the housing portion 11 in the lateral direction of the movable contact piece 16.

Thereby, the range of the magnetic flux flowing in the direction parallel to the longitudinal direction of the movable contact piece 16 in the housing space 12 can be widened. That is, as illustrated in FIG. 2, the magnetic flux M flowing from the first magnet 6*a* toward the second magnet 6*b* flows in the direction parallel to the longitudinal direction of the movable contact piece 16 even in a range close to the first inner wall surface 11*a* and the second inner wall surface 11*b*. Therefore, when the arc is extended toward the first inner wall surface 11*a* or the second inner wall surface 11*b*, the Lorentz force acts in the direction parallel to the lateral direction of the movable contact piece 16 until the arc hits the first inner wall surface 11*a* or the second inner wall surface 11*b*, so that the extension direction of the arc can be easily controlled in the intended direction.

Figure 4A:
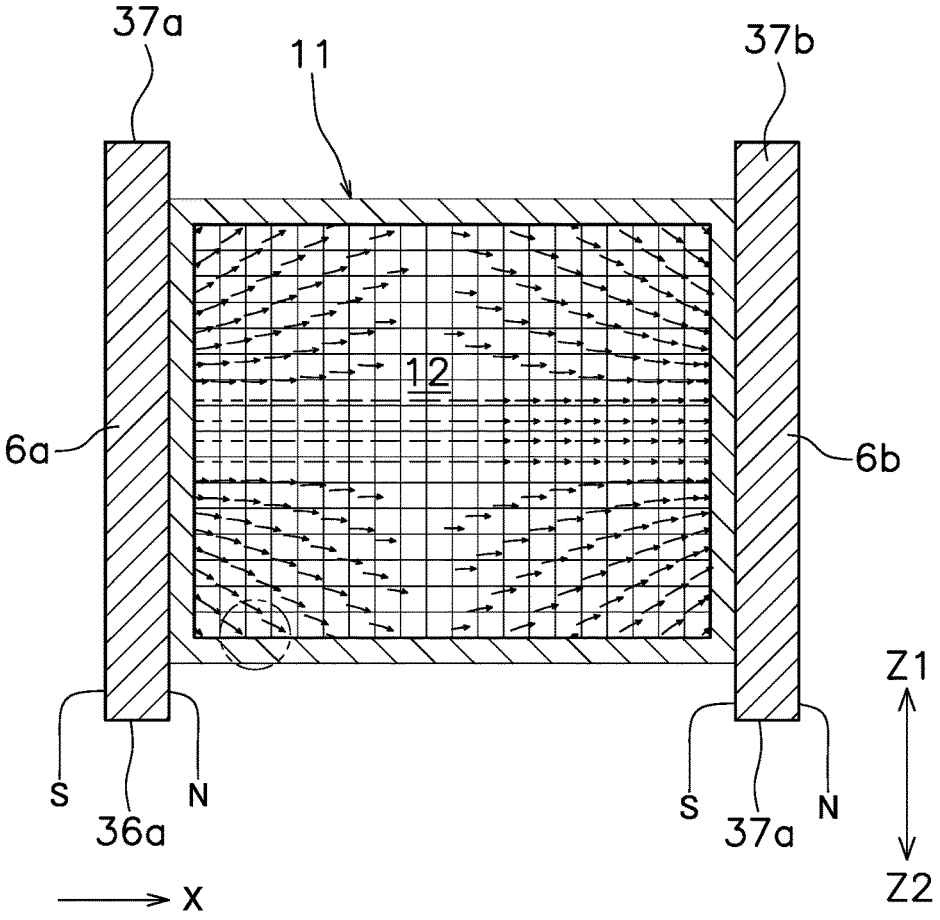
FIG. 4A is a view schematically showing a flow of a magnetic flux in a housing space.
Figure 4B:
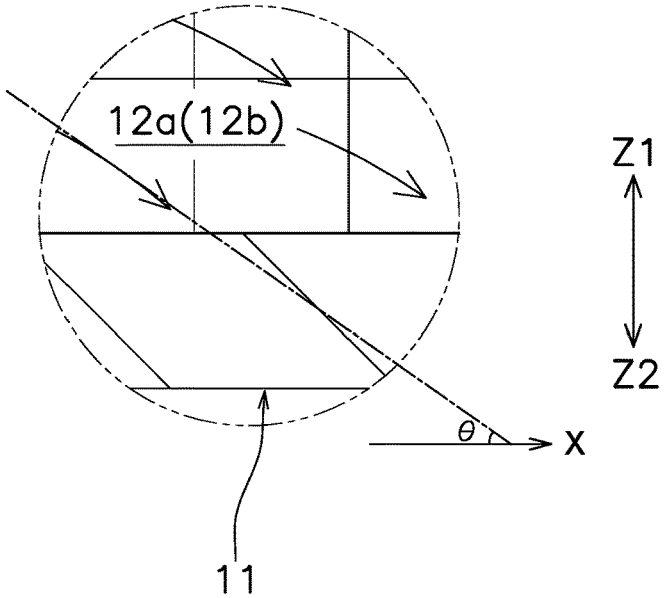
FIG. 4B is a partially enlarged view of FIG. 4A.

FIG. 4A is a view schematically showing the flow of the magnetic flux in the housing space 12 when the housing space 12 is viewed from the front-back direction. In detail, FIG. 4A is a schematic view of the flow of the magnetic flux near the center of the magnet portion 6*a* and the magnet 6*b* in the front-back direction as viewed from the front-back direction. FIG. 4B is a partially enlarged view of FIG. 4A, and is a view for explaining the relationship between the angle formed by the magnetic flux line flowing through the arc extension spaces 12*a* and 12*b* and the straight line parallel to the longitudinal direction of the movable contact piece 16. The angle formed by the magnetic flux line of the magnetic field in the arc extension spaces 12*a* and 12*b* and the straight line parallel to the longitudinal direction of the movable contact piece 16 is preferably within 45°. More specifically, in the arc extension spaces 12*a* and 12*b*, the angle formed by the magnetic flux line of the magnetic field at a position farthest from the movable contact piece 16 in the separation direction Z2 and the straight line parallel to the longitudinal direction of the movable contact piece 16 is preferably within 45°.

Specifically, as illustrated in FIG. 4B, in the arc extension spaces 12*a* and 12*b*, the acute angle θ formed by the straight line (X-axis) parallel to the longitudinal direction of the movable contact piece 16 and the tangent line of the magnetic flux line in the arc extension spaces 12*a* and 12*b* is preferably within 45°. In other words, it is preferable to dispose the arc extension spaces 12*a* and 12*b* within a range in which the acute angle θ formed by the straight line (X-axis) parallel to the longitudinal direction of the movable contact piece 16 and the tangent line of the magnetic flux line is within 45°. More specifically, the angle θ formed by the magnetic flux line of the magnetic field flowing through the bottoms of the arc extension spaces 12*a* and 12*b* and the straight line (X-axis) parallel to the longitudinal direction of the movable contact piece 16 is preferably within 45°. As a result, when the arc is extended in the arc extension spaces 12*a* and 12*b*, the direction of the Lorentz force acting on the arc can be prevented from changing significantly, so that the extension direction of the arc can be easily controlled in the intended direction.

Although an embodiment of the electromagnetic relay according to one aspect of the present invention has been described so far, the present invention is not limited to the above embodiment and various modifications can be made without departing from the gist of the invention. For example, the shape or arrangement of the housing 2, the contact device 3, the electromagnetic drive device 5, or the housing portion 11 may be changed.

For example, the magnet portion 6 may generates a magnetic field in the housing space 12 such that the arc hits the first inner wall surface 11*a* or the second inner wall surface 11*b*, and the arc does not hit the third inner wall surface 11*c* and the fourth inner wall surface 11*d*. Specifically, the first and second magnets 6*a* and the second magnet 6*b* may be sized to generate a magnetic field in the housing space 11*e* such that the arc hits the first inner wall surface 11*a* or second inner wall surface 11*b* and the arc does not hit the third inner wall 11*c* and fourth inner wall surface 11*d*.

Figure 5:
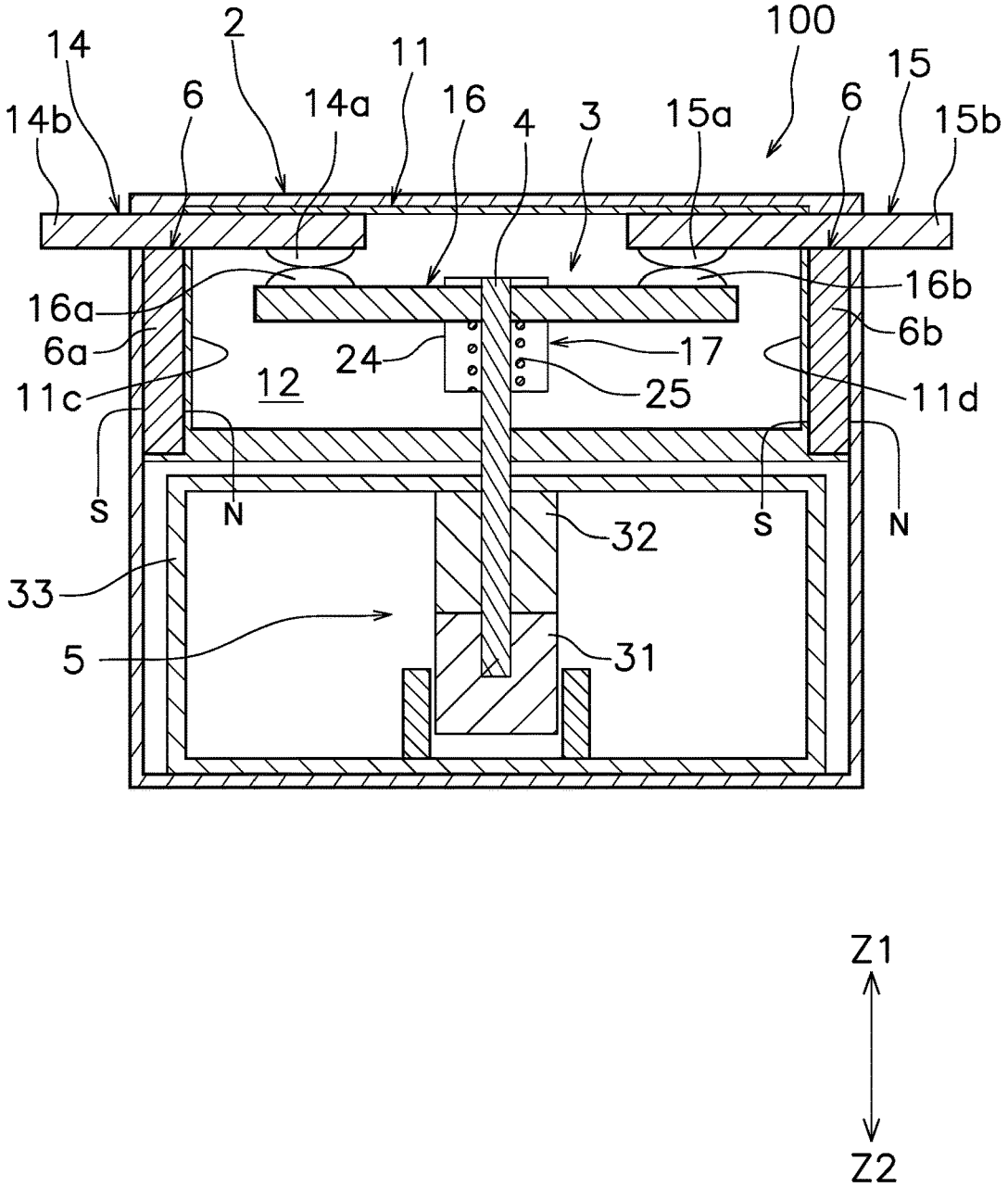
FIG. 5 is a schematic cross-sectional view of an electromagnetic relay.

For example, in the above embodiment, the first fixed terminal 14 and the second fixed terminal 15 are columnar terminals, but as illustrated in FIG. 5, the first fixed terminal 14 and the second fixed terminal 15 may be plate-shaped terminals extending in the longitudinal direction of the movable contact piece 16. In this case, the first fixed terminal 14 and the second fixed terminal 15 may be bent in a substantially L shape in the housing 2. Further, the first fixed terminal 14 and the second fixed terminal 15 may be disposed below the movable contact piece 16, the electromagnetic drive device 5 may operate to pull the movable contact piece 16 toward the first fixed terminal 14 and the second fixed terminal 15.

Figure 6:
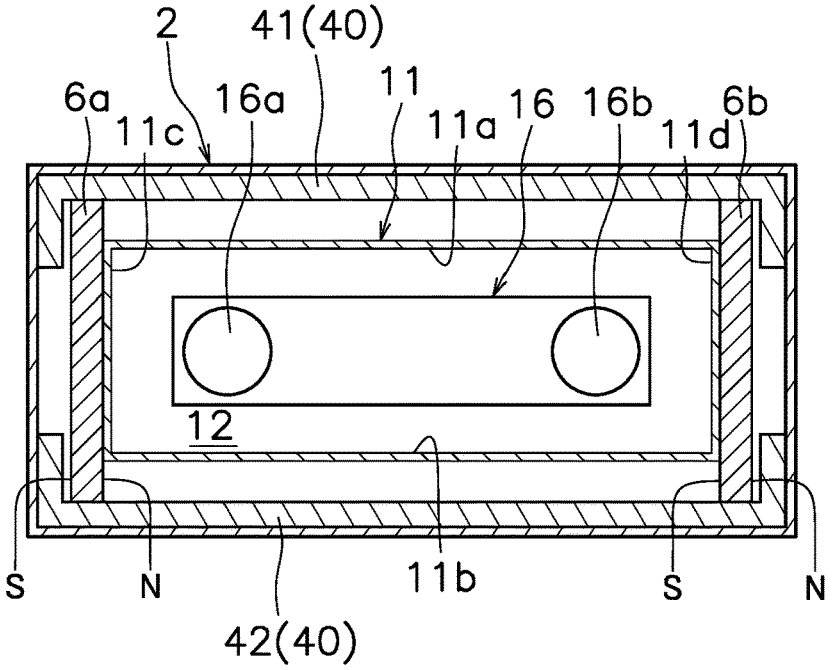
FIG. 6 is a schematic view showing a first modification of the magnet portion.

FIG. 6 is a schematic view showing a first modification of the magnet portion 6, and is a schematic view of a cross section around the housing portion 11 as viewed from above. The magnet portion 6 further includes a yoke 40 connected to at least one of the first magnet 6*a* and the second magnet 6*b*. In detail, the yoke 40 includes a first yoke 41 and a second yoke 42. The first yoke 41 and the second yoke 42 are connected to the first magnet 6*a* and the second magnet 6*b*.

The first yoke 41 extends in the up-down direction and extends in the longitudinal direction of the movable contact piece 16 in front of the housing space 11*e*. The lengths of the first yoke 41 and the second yoke 42 in the up-down direction are the same as the lengths of the first magnet 6*a* and the second magnet 6*b* in the up-down direction. The lengths of the first yoke 41 and the second yoke 42 in the up-down direction may be larger than the lengths of the first magnet 6*a* and the second magnet 6*b* in the up-down direction. One end of the first yoke 41 is connected to the first magnet 6*a*, and the other end of the first yoke 41 is connected to the second magnet 6*b*. Both ends of the first yoke 41 extend in the lateral direction of the movable contact piece 16 so as to surround the first magnet 6*a* and the second magnet 6*b* from the outside. The second yoke 42 has a shape symmetrical with respect to the first yoke 41 in the front-back direction, and one end thereof is connected to the first magnet 6*a* and the other end is connected to the second magnet 6*b*. The shape or arrangement of the yoke 40 may be appropriately changed according to the arrangement of the first magnet 6*a* and the second magnet 6*b*.

Figure 7:
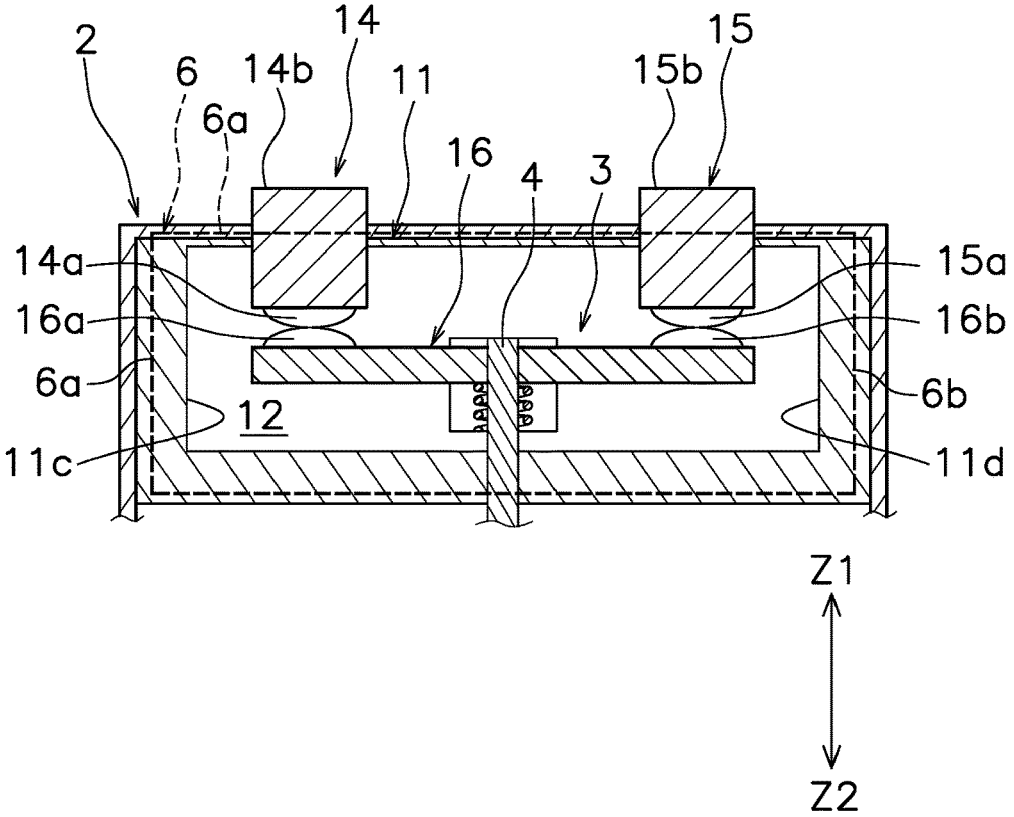
FIG. 7 is a schematic view showing a second modification of the magnet portion.
Figure 8:
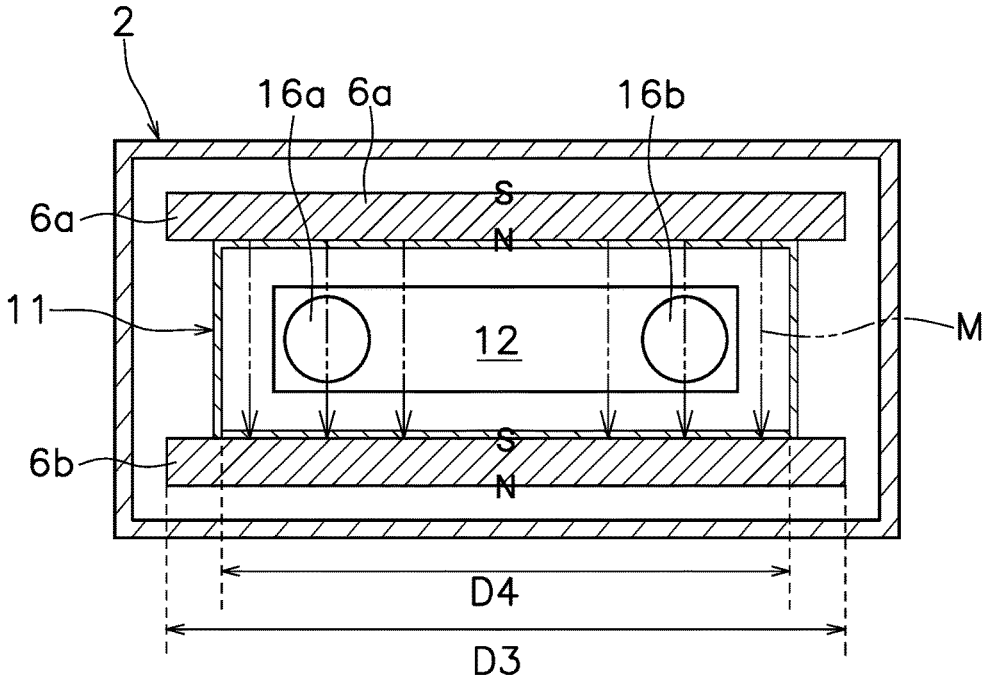
FIG. 8 is a schematic view showing a second modification of the magnet portion.

FIGS. 7 and 8 are schematic views showing a second modification of the magnet portion 6. FIG. 7 is a schematic view of a cross section around the housing portion 11 as viewed from the back. FIG. 8 is a schematic view of a cross section around the housing portion 11 as viewed from above.

The magnet portion 6 according to the second modification generates a magnetic flux that flows in a direction parallel to the lateral direction of the movable contact piece 16 between the first fixed contact 14*a* and the first movable contact 16*a*, and between the second fixed contact 15*a* and the second movable contact 16*b*. Specifically, the first magnet portion 6*a* and the second magnet 6*b* extend in the second direction beyond the housing space 12 and are disposed around the housing portion 11 so that different poles face each other in the lateral direction of the movable contact piece 16. The first magnet 6*a* is disposed on the front side of the housing portion 11. The second magnet 6*b* is disposed on the back side of the housing portion 11.

Further, as illustrated in FIG. 8, the dimensions D3 of the first magnet 6*a* and the second magnet 6*b* in the longitudinal direction of the movable contact piece 16 are preferably larger than the dimension D4 of the housing space 12 in the lateral direction of the movable contact piece 16. Specifically, both ends of the first magnet 6*a* in the longitudinal direction of the movable contact piece 16 extend outward in the longitudinal direction of the movable contact piece 16 beyond the housing space 12. Both ends of the second magnet 6*b* in the longitudinal direction of the movable contact piece 16 extend outward beyond the housing space 12 in the longitudinal direction of the movable contact piece 16. In the second modification, the angle formed by the magnetic flux line of the magnetic field in the arc extension spaces 12*a* and 12*b* and the straight line parallel to the lateral direction of the movable contact piece 16 is preferably within 45°. More specifically, in the arc extension spaces 12*a* and 12*b*, the angle formed by the magnetic flux line of the magnetic field at the position farthest from the movable contact piece 16 in the separation direction Z2 and the straight line parallel to the lateral direction of the movable contact piece 16 is preferably within 45°.

Figure 9:
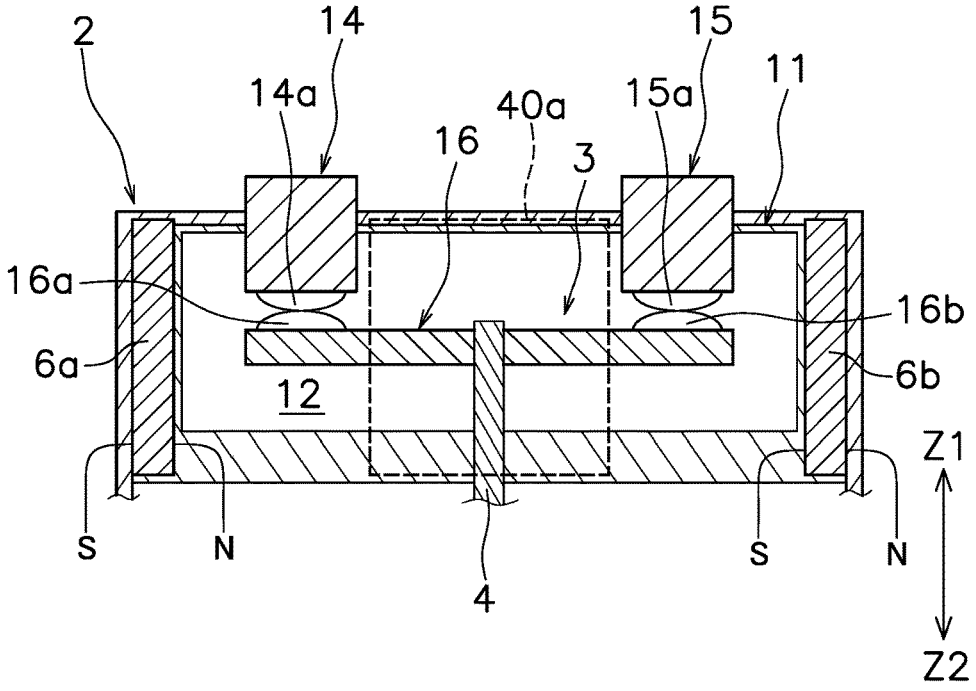
FIG. 9 is a schematic view showing a third modified example of the magnet portion.
Figure 10:
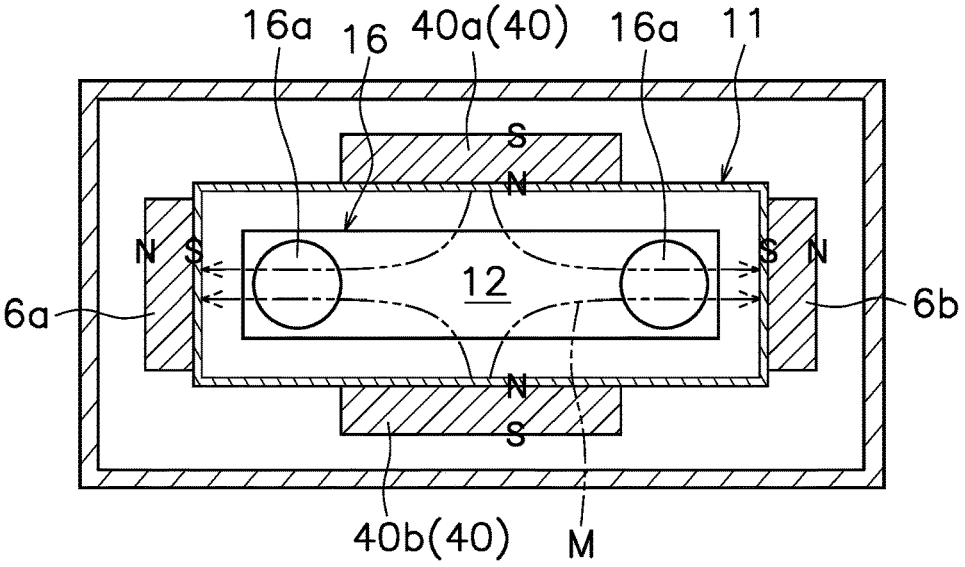
FIG. 10 is a schematic view showing a third modified example of the magnet portion.
Figure 11:
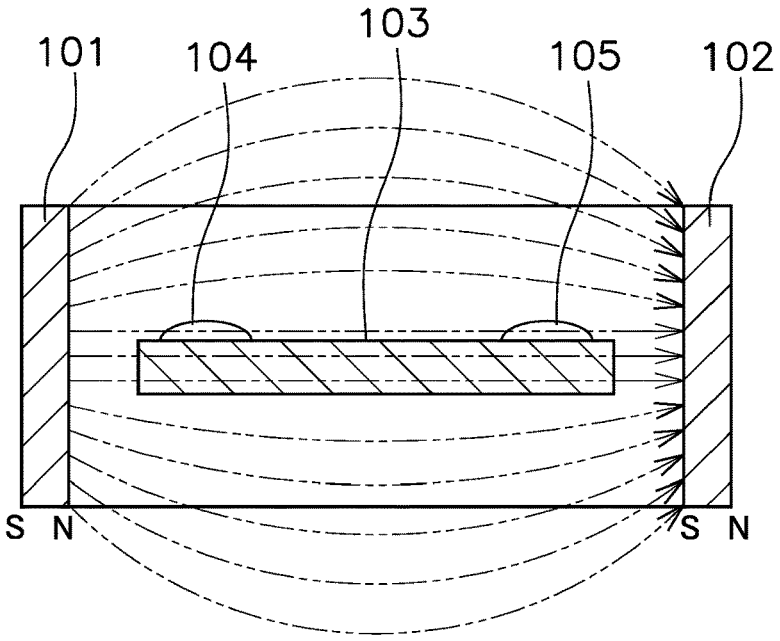
FIG. 11 is a view schematically showing a magnetic flux flowing between a pair of magnets.

FIGS. 9 and 10 are schematic views showing a third modification of the magnet portion 6. FIG. 9 is a schematic view of the cross section around the housing portion 11 as viewed from the back. FIG. 10 is a schematic view of a cross section around the housing portion 11 as viewed from above.

The magnet portion 6 according to the third modification further includes a third magnet 40*a* and a fourth magnet 40*b*. The third magnet 40*a* and the fourth magnet 40*b* are examples of a pair of second magnets. As illustrated in FIG. 10, the third magnet 40*a* and the fourth magnet 40*b* are disposed around the housing portion 11 so that the same poles (here, the N poles) face each other in the lateral direction of the movable contact piece 16. As illustrated in FIG. 9, the third magnet 40*a* and the fourth magnet 40*b* extend in the separation direction Z2 beyond the housing space 12. The third magnet 40*a* and the fourth magnet 40*b* extend in the contact direction Z1 beyond the housing space 12. The third magnet 40*a* and the fourth magnet 40*b* are disposed near the center of the movable contact piece 16 in the longitudinal direction. The dimensions of the third magnet 40*a* and the fourth magnet 40*b* in the left-right direction are smaller than the dimensions of the movable contact piece 16 in the left-right direction.

The first magnet 6*a* and the second magnet 6*b* are disposed around the housing portion 11 so that the same poles (here, the S poles) face each other in the longitudinal direction of the movable contact piece 16. The dimensions of the first magnet 6*a* and the second magnet 6*b* in the front-back direction are about the same as the dimensions of the housing space 12 in the front-back direction.

With the first to fourth magnets 6*a*, 6*b*, 40*a*, and 40*b* disposed as described above, the magnetic flux M flows between the first fixed contact 14*a* and the first movable contact 16*a*, and between the second fixed contact 15*a* and the second movable contact 16*b* in the direction parallel to the longitudinal direction of the movable contact piece 16, as illustrated in FIG. 10.

REFERENCE NUMERALS

6 Magnet portion
6*a* First magnet
6*b* Second magnet
11 Housing portion
12 Housing space
12*a*, 12*b* Arc extension space
14 First fixed terminal
14*a* First fixed contact (example of fixed contact)
15 Second fixed terminal
15*a* Second fixed contact (example of fixed contact)
16 Movable contact piece
16*a* First movable contact (example of movable contact)
16*b* Second movable contact (example of movable contact)
40*a* Third magnet
40*b* Fourth magnet
100 Electromagnetic relay

The invention claimed is:

1. An electromagnetic relay, comprising:

a pair of fixed terminals including a fixed contact;

a movable contact piece including a movable contact disposed facing the fixed contact, the movable contact piece being movable in a first direction in which the movable contact contacts the fixed contact and a second direction in which the movable contact separates from the fixed contact;

a housing portion including a housing space configured to house the fixed contact and the movable contact piece; and a magnet portion configured to generate a magnetic flux flowing in a direction parallel to a longitudinal direction of the movable contact piece between the fixed contact and movable contact, the magnet portion including a pair of first magnets, the pair of first magnets disposed around the housing portion so as to face each other in the longitudinal direction of the movable contact piece and extending in the second direction beyond the housing space, wherein the housing space includes an arc extension space configured to extend an arc generated between the fixed contact and the movable contact, the arc extension space disposed at least partially on a second direction side with respect to the movable contact piece, and in the arc extension space, an angle formed by a magnetic flux line of a magnetic field at a position farthest from the movable contact piece in the second direction and a straight line parallel to the longitudinal direction is within 45°.

2. The electromagnetic relay according to claim 1, wherein a dimension of each of the pair of first magnets in a lateral direction of the movable contact piece is larger than a dimension of the housing space in the lateral direction.

3. The electromagnetic relay according to claim 2, wherein the pair of first magnets have different polarities facing each other.

4. The electromagnetic relay according to claim 1, wherein the magnet portion further includes a pair of second magnets, the pair of second magnets disposed around the housing portion so as to face each other in a lateral direction of the movable contact piece and extending in the second direction beyond the housing space.

5. The electromagnetic relay according to claim 4, wherein the pair of first magnets and the pair of second magnets extend in the first direction beyond the housing space.

6. The electromagnetic relay according to claim 1, wherein the pair of first magnets extends in the first direction beyond the housing space.

7. The electromagnetic relay according to claim 1, wherein the pair of fixed terminals has a plate shape and extends in a longitudinal direction of the movable contact piece.

8. An electromagnetic relay, comprising:

a pair of fixed terminals including a fixed contact;

a movable contact piece including a movable contact disposed facing the fixed contact, the movable contact piece being movable in a first direction in which the movable contact contacts the fixed contact and a second direction in which the movable contact separates from the fixed contact;

a housing portion including a housing space configured to house the fixed contact and the movable contact piece; and a magnet portion configured to generate a magnetic flux flowing in a direction parallel to a lateral direction of the movable contact piece between the fixed contact and movable contact, the magnet portion including a pair of first magnets, the pair of first magnets disposed around the housing portion so as to face each other in the lateral direction of the movable contact piece and extending in the second direction beyond the housing space, wherein the housing space includes an arc extension space configured to extend an arc generated between the fixed contact and the movable contact, the arc extension space disposed at least partially on a second direction side with respect to the movable contact piece, and in the arc extension space, an angle formed by a magnetic flux line of a magnetic field at a position farthest from the movable contact piece in the second direction and a straight line parallel to the lateral direction is within 45°.

9. The electromagnetic relay according to claim 8, wherein a dimension of each of the pair of first magnets in a longitudinal direction of the movable contact piece is larger than a dimension of the housing space in the longitudinal direction.

* * * * *